US005175919A

United States Patent [19]

Lo

[11] Patent Number: 5,175,919

[45] Date of Patent: Jan. 5, 1993

[54] METHOD FOR MANUFACTURING A RACKET FRAME

[76] Inventor: Kun-Nan Lo, No. 33, Hsiang-Ho Rd, Li-Lin Tsun, Tan-Tzu Hsiang, Taichung Hsien, Taiwan

[21] Appl. No.: 886,685

[22] Filed: May 20, 1992

[51] Int. Cl.[5] ..... B23P 19/04; B65C 3/26; A63B 49/00

[52] U.S. Cl. ..... 29/460; 29/428; 156/156; 156/191; 273/73 F; 273/73 H

[58] Field of Search ..... 29/460, 428, 469.5; 273/73 R, 73 C, 73 F, 73 G, 73 H, 73 K; 156/156, 157, 166, 169, 184, 188, 191; 264/258

[56] References Cited

U.S. PATENT DOCUMENTS

| | | | |
|---|---|---|---|
| 1,630,683 | 5/1927 | Williamson | 273/73 G |
| 3,724,850 | 4/1973 | Stevens | 273/73 GX |
| 4,264,389 | 4/1981 | Staus et al. | 273/73 FX |
| 4,906,002 | 3/1990 | Goffrey et al. | 273/73 G |

*Primary Examiner*—Timothy V. Eley

*Attorney, Agent, or Firm*—Ladas & Parry

[57] ABSTRACT

A method for manufacturing a racket frame includes the steps of making a metal part having at least one joint end formed with a groove; covering the joint end of the metal part with a layer containing glass fibers to serve as an electrical insulating layer; making a preformed plastic part by wrapping a resin saturated carbon fiber material around a tube unit and by providing at least one end portion in the tube unit which has a wrapping layer thinner than that of the remaining portion of the tube unit to serve as a joint end; folding the end portion of the tube unit to seal the tube unit; inserting the folded end portion of the tube unit into the groove; wrapping and fastening the joint end of the metal part and the plastic part adjacent to the joint end of the tube unit with a resin saturated carbon fiber layer; forming and heating the metal part and the preformed plastic part in a mold; and supplying a compressed air into the tube unit to create a predetermined pressurizing force during the forming and heating step.

3 Claims, 6 Drawing Sheets

METHOD FOR MANUFACTURING A RACKET FRAME

BACKGROUND OF THE INVENTION

1. Field of the Invention

This invention relates to a racket frame, more particularly to a method for manufacturing a racket frame.

2. Description of Related Art

In the manufacture of metal racket frames, separate parts of each metal racket frame have heretofore been interconnected via welding or screw fastener. Generally, the joints of the separate parts reside in the throat, in the head and/or in the shaft of the racket frame. Such conventional joints are liable to break due to stress concentration. Attempts were made to strengthen the joints by wrapping a resin saturated carbon fiber layer around the joints. However, effective bonding cannot be achieved because there is electrostatic repulsion between the resin saturated carbon fiber layer and the parts of the metal racket frame.

SUMMARY OF THE INVENTION

The objective of this invention is to provide a method for manufacturing a racket frame in which a metal part can be bonded effectively to the other part made of carbon fiber reinforced plastic. Another objective is to provide a method of manufacturing a racket frame which has a metal part and a carbon fiber reinforced plastic part.

Accordingly, a method of this invention for manufacturing a racket frame includes the steps of: (a) making a metal part having at least one joint end formed with an engaging groove; (b) covering the joint end of the metal part with a layer containing glass fibers to serve as an electrical insulating layer; (c) making a preformed plastic part by wrapping a resin saturated carbon fiber material around a tube means and by providing at least one end portion in the tube means which has a wrapping layer thinner than that of the remaining portion of the tube means in order to serve as a joint end; (d) folding the end portion of the tube means to seal the tube means; (e) inserting the folded end portion of the tube means into the engaging groove of the joint end of the metal part; (f) wrapping and fastening the joint end of the metal part and the plastic part adjacent to the joint end of the tube means with a resin saturated carbon fiber layer; (g) forming and heating the metal part and the preformed plastic part in a mold; and (h) supplying a compressed air into the tube means to create a predetermined pressurizing force during forming and heating the metal part and the preformed plastic part.

BRIEF DESCRIPTION OF THE DRAWING

Other features and advantages of the present invention will become apparent in the following detailed description of the preferred embodiments, with reference to the accompanying drawings, of which.

DETAILED DESCRIPTION OF THE INVENTION

Figure 1:
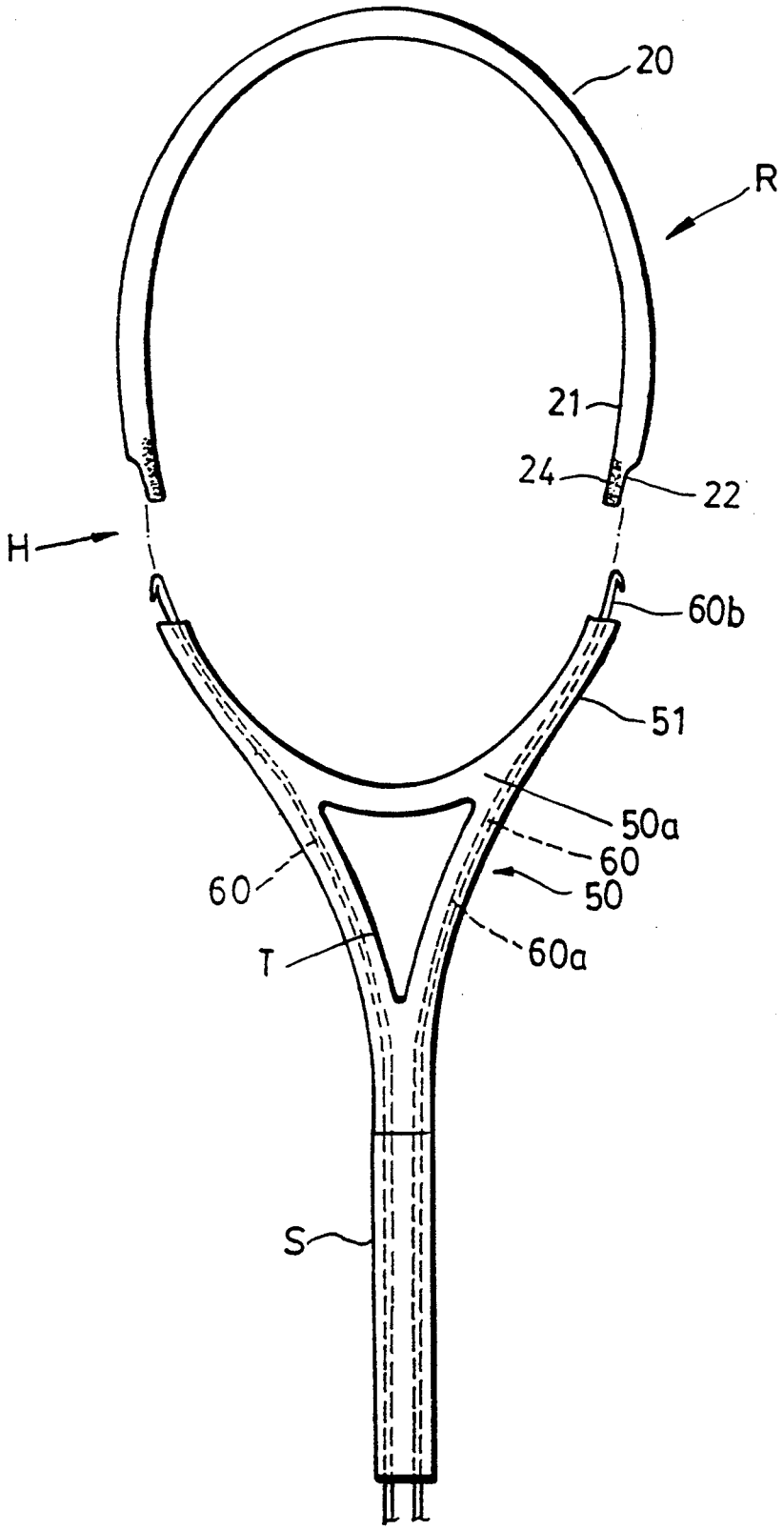
FIG. 1 is a schematic view of a racket frame manufactured by the method of this invention.
Figure 2:
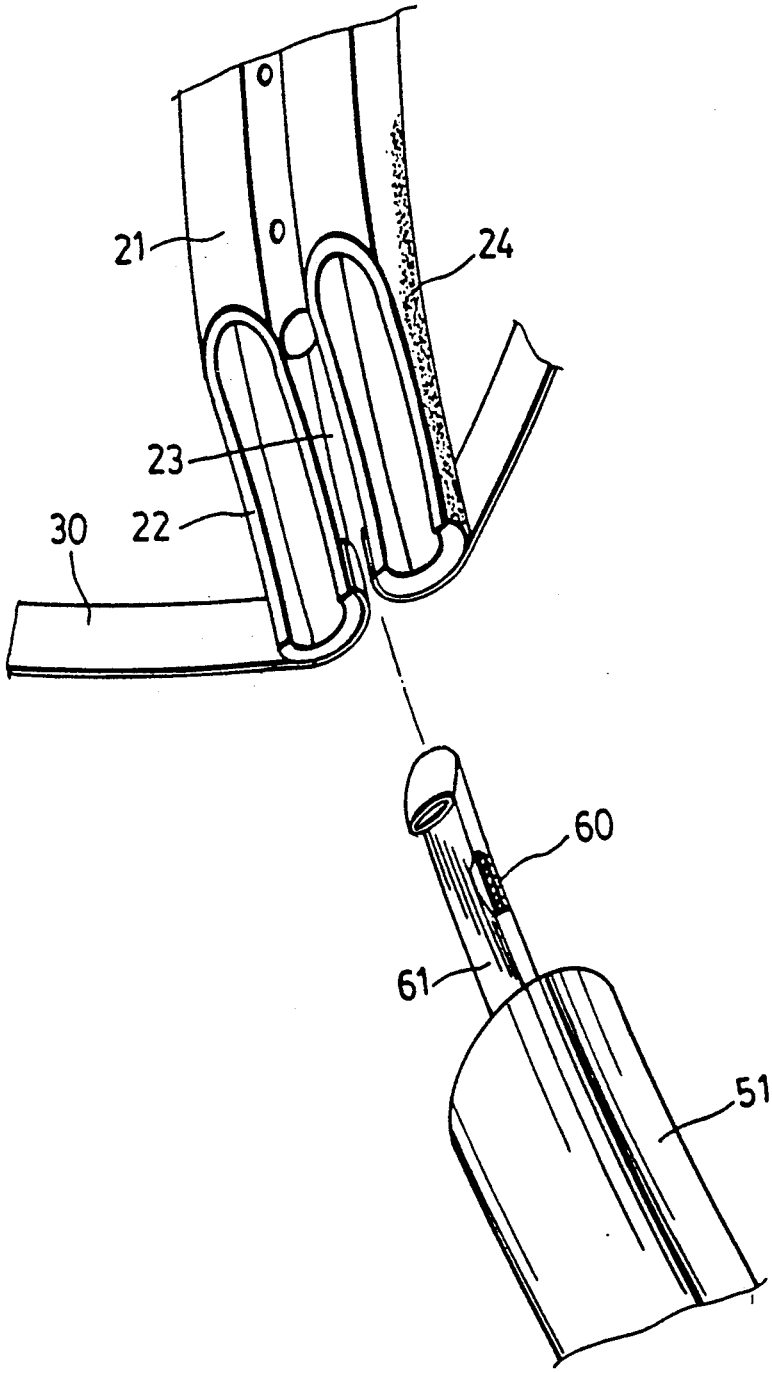
FIG. 2 is a perspective view showing that the tube of the plastic part is to be inserted in the groove portion of the metal part of the racket frame.
Figure 3:
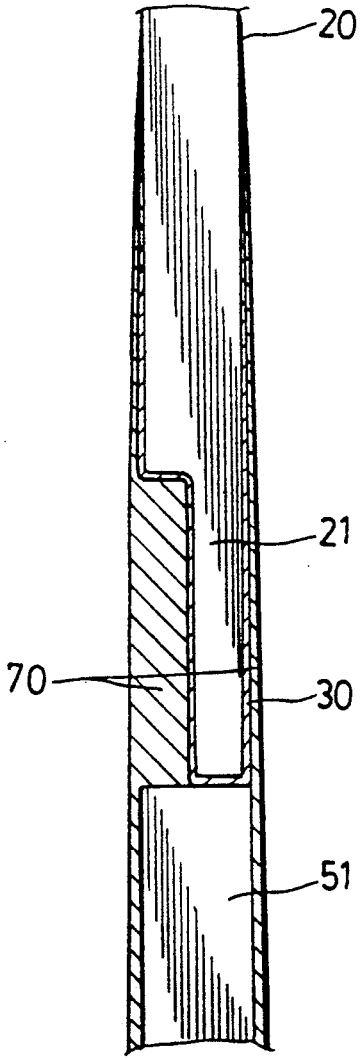
FIG. 3 shows wrapping and fastening the joint end of the metal part and the plastic part adjacent to the joint end of the tube means with a resin saturated carbon fiber layer.
Figure 4:
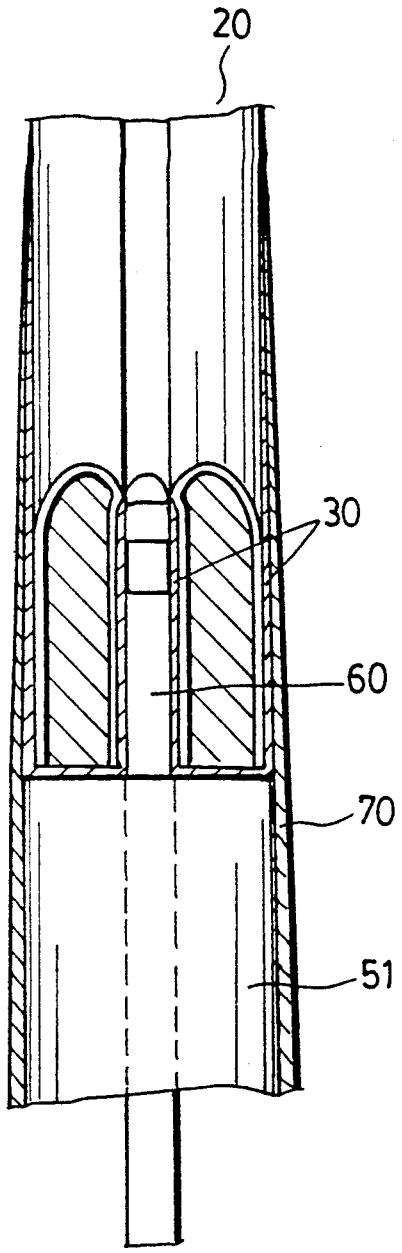
FIG. 4 is a partial sectional view of the racket frame.

FIGS. 1 to 4 show a racket frame (R) which includes a metal part (20). The metal part (20) is made of a metal frame of an arcuate shape and forms a portion of a head (H) of the racket frame (R). The metal part (20) includes two joint ends (21), each of which has a notch portion (22) and two prongs to define a groove portion (23). Each joint end (21) further has an inner roughened surface (24). A glass fiber layer (30) which is saturated with resin covers each joint end (21) of the metal part (20) in order to serve as an electrical insulating layer. The racket frame (R) further has a preformed plastic part (50) which includes an arcuate portion (50*a*) to be connected to the joint ends (21) of the arcuate metal part (20) in order to complement the arcuate metal part (20) so as to form the head (H) of the racket frame (R), a Y-shaped throat portion (T) connected to the arcuate portion (50*a*) and a shaft portion (S) connected to the Y-shaped portion (T). In FIG. 1, a tube means (60*a*) made of a material such as cellophane includes a pair of tubes (60) which are juxtaposed at lower portions and which separate and diverge from each other at their upper portions. The preformed plastic part (50) is made by wrapping a resin saturated carbon fiber material (61) around the tubes (60). Each tube (60) is provided with an end portion (60*b*) which has a wrapping layer thinner than that of the remaining portion of the tube (60) in order to serve as a joint end. As shown in FIG. 1, the tubes (60) extend from the shaft portion (S) to the end portions (51) of the arcuate portion (50*a*) through the Y-shaped throat portion (T). The end portion (60*b*) of each tube (60) is folded so as to seal the tube (60). Each folded end portion (60*b*) of the tube (60) is inserted in the groove portion (23) of one of the joint ends (21) of the metal part (20). Afterwards, each joint end (21) of the metal part (20) and each end portion (51) of the plastic part (50) are wrapped and fastened with a resin saturated carbon fiber layer (70). The metal part (20) and the preformed plastic part (50) so connected are placed and heated in a mold, and a compressed air is simultaneously supplied into the tubes (60) in order to create a predetermined pressurizing force during forming and heating of the metal part (20) and the preformed plastic part (50).

The glass fiber layer (30) is an electrical insulating material. Since each joint end (21) of the metal part (20) is covered with the glass fiber layer (30), there is no electrostatic repulsion effect on the joint between the metal part (20) and the preformed plastic part (50), thereby achieving an effective bonding therebetween. Furthermore, the pressurizing force introduced in the tubes (60) causes the resin saturated carbon fiber material (61) to abut intimately abut the adjacent resin saturated carbon fiber layer (70). Since no fasteners and welding exist at the joint between the metal part (20) and the preformed plastic part (50), the problem of stress concentration can be alleviated.

Note that like elements are indicated by the same reference numerals throughout the disclosure.

Figure 5:
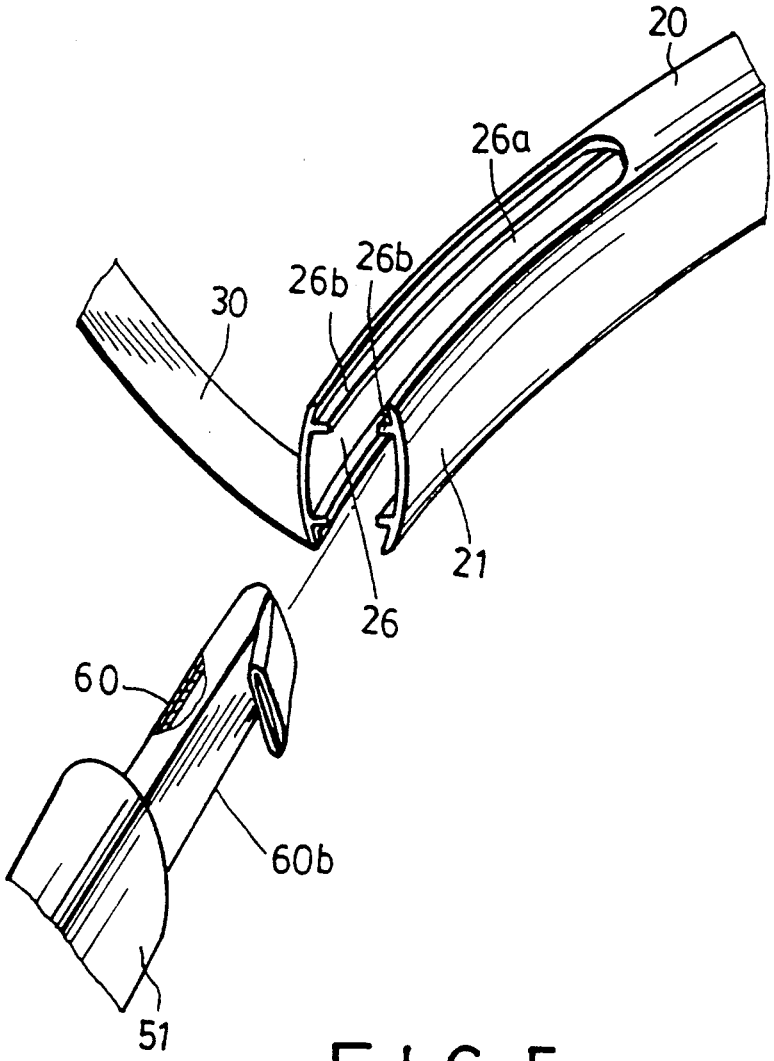
FIG. 5 is a perspective view showing a second embodiment of the metal part of the racket frame.
Figure 6:
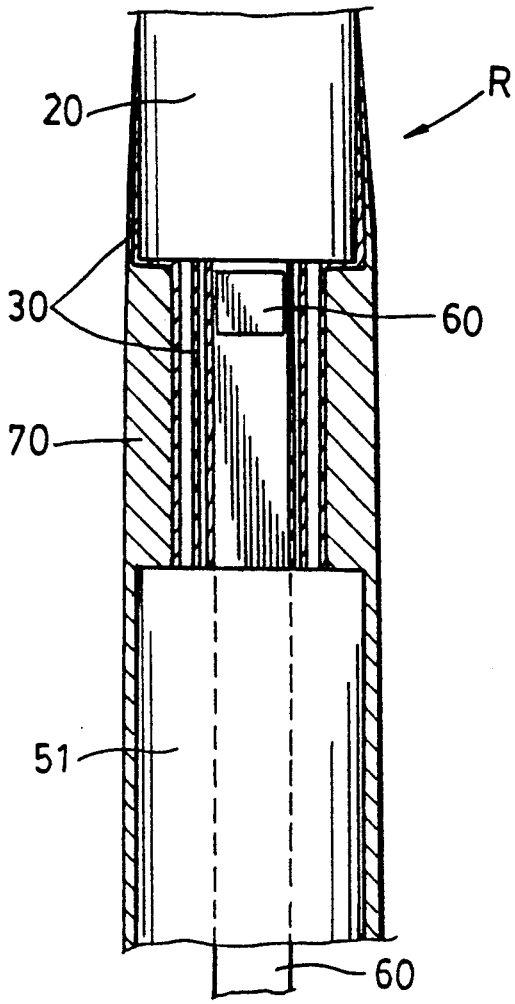
FIG. 6 is a sectional view showing the joint end of the metal part in FIG. 5 connected with the joint end of the plastic part.
Figure 7:
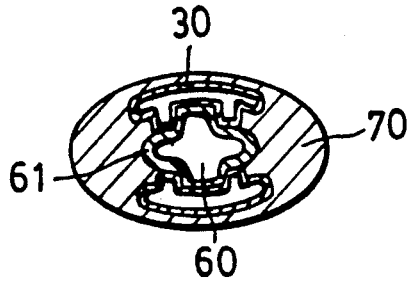
FIG. 7 is a sectional view showing the resin saturated carbon fiber layer wrapping and fastening the joint end of the metal part and the tube means in FIG. 5.

FIGS. 5 to 7 show a second preferred embodiment of the metal part (20) of the racket frame (R). Each joint end (21) of the metal part (20) is forked, provided with two opposite longitudinal grooves (26*a*) and two pairs of elongated ribs (26*b*), and defines a space (26) between the ribs (26*b*). The glass fiber layer (30) is covered on the joint end (21) as shown in FIG. 6. The remaining steps of the method for manufacturing the racket frame (R) with the second preferred embodiment of the metal part (20) are similar to the steps of the above described method. The folded end portion (60*b*) is inserted in and engages the space (26*b*). The resin saturated carbon fiber layer (70) wraps and fastens the joint end (21) of the metal part (20) and the end portion (51) of the arcuate portion (50*a*) of the preformed plastic part (50). The resin saturated carbon fiber layer (70) engages the ribs (26*b*) during forming and heating the metal part (20) and the preformed plastic part (50) so as to facilitate the engagement of the folded end portion (60*b*) in the space (26).

The preformed plastic part (50) of the racket frame (R) manufactured by the method of this invention provides the effect for absorbing vibration transmitted from the metal part (20) so as to damp the impact which is to be transmitted to the user's hand. As a result, the user can comfortably hold and use the racket formed with the racket frame (R).

While the present invention has been described in connection with what is considered the most practical and preferred embodiment, it is understood that this invention is not limited to the disclosed embodiments but is intended to cover various arrangements included within the spirit and scope of the broadest interpretations and equivalent arrangements.

I claim:

1. A method for manufacturing a racket frame comprising the steps of:

making a metal part having at least one joint end formed with an engaging groove;

covering said joint end of said metal part with a layer containing glass fibers to serve as an electrical insulating layer;

making a preformed plastic part by wrapping a resin saturated carbon fiber material around a tube means and by providing at least one end portion in said tube means which has a wrapping layer thinner than that of the remaining portion of said tube means in order to serve as a joint end;

folding said end portion of said tube means to seal said tube means;

inserting said folded end portion of said tube means into said engaging groove of said joint end of said metal part;

wrapping and fastening said joint end of said metal part and said plastic part adjacent to said joint end of said tube means with a resin saturated carbon fiber layer;

forming and heating said metal part and said preformed plastic part in a mold; and supplying a compressed air into said tube means to create a predetermined pressurizing force during forming and heating said metal part and said preformed plastic part.

2. A method for manufacturing a racket frame as claimed in claim 1, wherein the step of making said metal part includes forming a metal tube into an arcuate shape which is a portion of a head of said racket frame and which has two joint ends formed with two engaging grooves respectively, the step of making said preformed plastic part including wrapping said resin saturated carbon fiber material around two tubes which are juxtaposed in part and then separated to form a Y-shape.

3. A method for manufacturing a racket frame as claimed in claim 1, further comprising the step of roughening an inner surface of said joint end of said metal part before the covering step.

* * * * *